United States Patent [19]

Ambrose et al.

[11] Patent Number: 4,457,055

[45] Date of Patent: Jul. 3, 1984

[54] METHOD FOR FORMING NEEDLED, NON-WOVEN FIBER PADDING

[75] Inventors: Jere B. Ambrose; Donald D. Van Compernolle, both of Holland, Mich.; Alfred L. Davis, Thompson, Ga.

[73] Assignee: Northern Fibre Products Co., Holland, Mich.

[21] Appl. No.: 412,573

[22] Filed: Aug. 30, 1982

[51] Int. Cl.[3] ..... D04H 1/46

[52] U.S. Cl. ..... 28/111

[58] Field of Search ..... 28/107, 111; 19/82, 19/83

[56] References Cited

U.S. PATENT DOCUMENTS 3,950,587 4/1976 Colijn et al. ..... 28/111 X

FOREIGN PATENT DOCUMENTS 275175 10/1969 Austria ..... 28/111
2254484 5/1974 Fed. Rep. of Germany ..... 28/111
2630514 1/1978 Fed. Rep. of Germany ..... 28/107
40-1805 2/1965 Japan ..... 28/111
6605768 5/1967 Netherlands ..... 28/111
931611 7/1963 United Kingdom ..... 28/111

OTHER PUBLICATIONS

Burns, G. F., "Spooner Develops Equipment and Technology for Needled Velours Floor-coverings", Textile Month, (Feb. 1973), pp. 69–71.

*Primary Examiner*—Robert Mackey
*Attorney, Agent, or Firm*—Cullen, Sloman, Cantor, Grauer, Scott and Rutherford

[57] ABSTRACT

An improved method for manufacturing a relatively thick, needled, non-woven fiber padding eliminates the conventional step of initially making a laminated blanket of garnet formed, thin, oriented fiber layers. Instead, this method initially forms a thick, single layer blanket of loosely piled, randomly oriented fibers, which blanket is simultaneously compressed and tack needled incremently along its entire length to intertwine and mechanically interlock random portions of the fibers. Thereafter, the conventional needling step is applied to complete the padding.

1 Claim, 8 Drawing Figures

METHOD FOR FORMING NEEDLED, NON-WOVEN FIBER PADDING

BACKGROUND OF INVENTION

The invention herein relates to a method for making non-woven fiber pads which are needled to form a thick material known as "shoddy". This material is useful as padding in furniture and within automobile upholstery and as soundproofing material within automotive bodies and the like.

Such non-woven material or "shoddy" is commonly made of fibers obtained from recycling or tearing apart rags. Thus, conventionally the material is produced by shredding or tearing apart rags or other cloth to obtain the loose fibers. These fibers are then passed into garnets, which are fiber distributors that lay fibers upon a collection belt located between them.

Conventionally, a number of garnets are located above the collection belt. Each garnet lays the fibers in a generally parallel, thin layer either transversely of the belt or alternatively in a limited length, longitudinal direction of the belt. Thus, the garnets form layers of oriented or parallel fibers, one layer upon another. The fibers of each layer are generally of the same directional orientation and are transverse to the fibers of the next adjacent layer. The resulting lamination of fiber layers generally resembles the formation of plywood, with each ply being thin and directionally oriented transversely to the ply above and below it.

The layered, relatively thick blanket produced by the garnets upon the conveyor is then conventionally carried through a needling apparatus. This apparatus generally comprises a platen having a large number of closely spaced or densely packed needles arranged to penetrate through the blanket. The needling platen may be applied against a back-up platen located on the opposite side of the blanket or alternatively, at times, a pair of needling platens may be used, with the two opposing each other.

The needling platen or platens move up and down rapidly so that the fabric is repeatedly hit by the needles which penetrate through the fabric. These needles displace the fibers and cause them to intertwine for interlocking the fiber layers together. These needles may be either straight pointed needles or alternatively, may have a barb-like pointed tip for increasing the intertwining of the fibers during each stroke of the needling platen.

Each increment or portion along the length of the blanket is repeatedly penetrated by the needles so that the resulting pad is formed by randomly oriented, intertwined fibers which make the pad relatively dimensionally stable both as to thickness and as to its planar dimensions. The resulting pad may then be either rolled up for shipment to the user or alternatively may be cut into pieces for particular desired uses.

The above-described procedure for manufacturing shoddy is limited by the productive capabilities of the garnets which operate relatively slowly. That is, in general, each garnet involves a mechanism that traverses the carrier conveyor belt to lay down the fibers. The movement of the garnet or the distribution part of the garnet is relatively slow so as to limit production. In addition, a failure of any garnet in a multi-garnet line can shut down the equipment. Garnets themselves, require maintenance and thus, additional service labor.

In the past, it was believed that a blanket could not be effectively needled, without tearing it apart, unless the blanket is formed of uni-directional or oriented fiber thin layers. In the absence of layering, the needling, which takes place rapidly and with the needles moving transversely of the blanket, tends to tear or rip apart the blanket. Thus, the garnets have been considered to be essential to the production of this kind of padding even though it would be desirable to eliminate them for the reasons mentioned above as well as for other reasons. However, until now, no practical way had been conceived for eliminating the garnets and the layering effect required by the garnets.

SUMMARY OF INVENTION

The invention herein comtemplates manufacturing shoddy or non-woven random oriented fiber padding which is needled, as in the past, but without the need for garnets or oriented fiber layers. More specifically, we have discovered that satisfactory needling can be performed upon a blanket which is made of randomly oriented, loosely piled fibers, rather than oriented layers, provided the blanket has been pinched or compressed while simultaneously needle tacking it before the conventional needling step. Tacking generally comprises extending or pushing needles through the blanket layer, but using considerably less needles which are much less densely packed than the normal needling procedure so that in essence, widely spaced needle penetrations are utilized, as compared with the more densely packed conventional needle platen.

In general, the improved process herein comtemplates, as in the past, collecting fibers, such as from shredded rags or other cloth. Next, the fibers are laid upon a conveyor in a thick, single layer blanket formed of loosely piled fibers. The garnets are omitted. This blanket, after suitable procedures for spreading the fibers evenly, is incremently pinched or compressed, such as by passing it through opposed rollers. Simultaneously to the pinching, tacking needles are inserted through the blanket. The resultant product is a single layer of randomly oriented fibers, portions of which fibers are intertwined. Thereafter, conventional needling is performed.

We have discovered that by using the compression-tacking step, the conventional needling step does not tear or otherwise damage the blanket and a better resultant padding is obtained.

With this improved method, the compression-needling step permits the use of a single layer blanket so that the necessity of using garnets is gone. Since the garnets are eliminated entirely, the production speed and capability of a non-woven padding line can be considerably increased. The maintenance, repair and failure and the like problems which have been associated with garnets in the past are eliminated.

Thus, it can be seen that the principal objective of this invention is to eliminate entirely the use of garnets and to replace the usual number of garnets with a simplified compression-tacking device.

These and other objects and advantages of this invention will become apparent upon reading the following description, of which the attached drawings form a part.

DETAILED DESCRIPTION

Figures 1, 2, 3, 4, 5, 6, 7, 8:
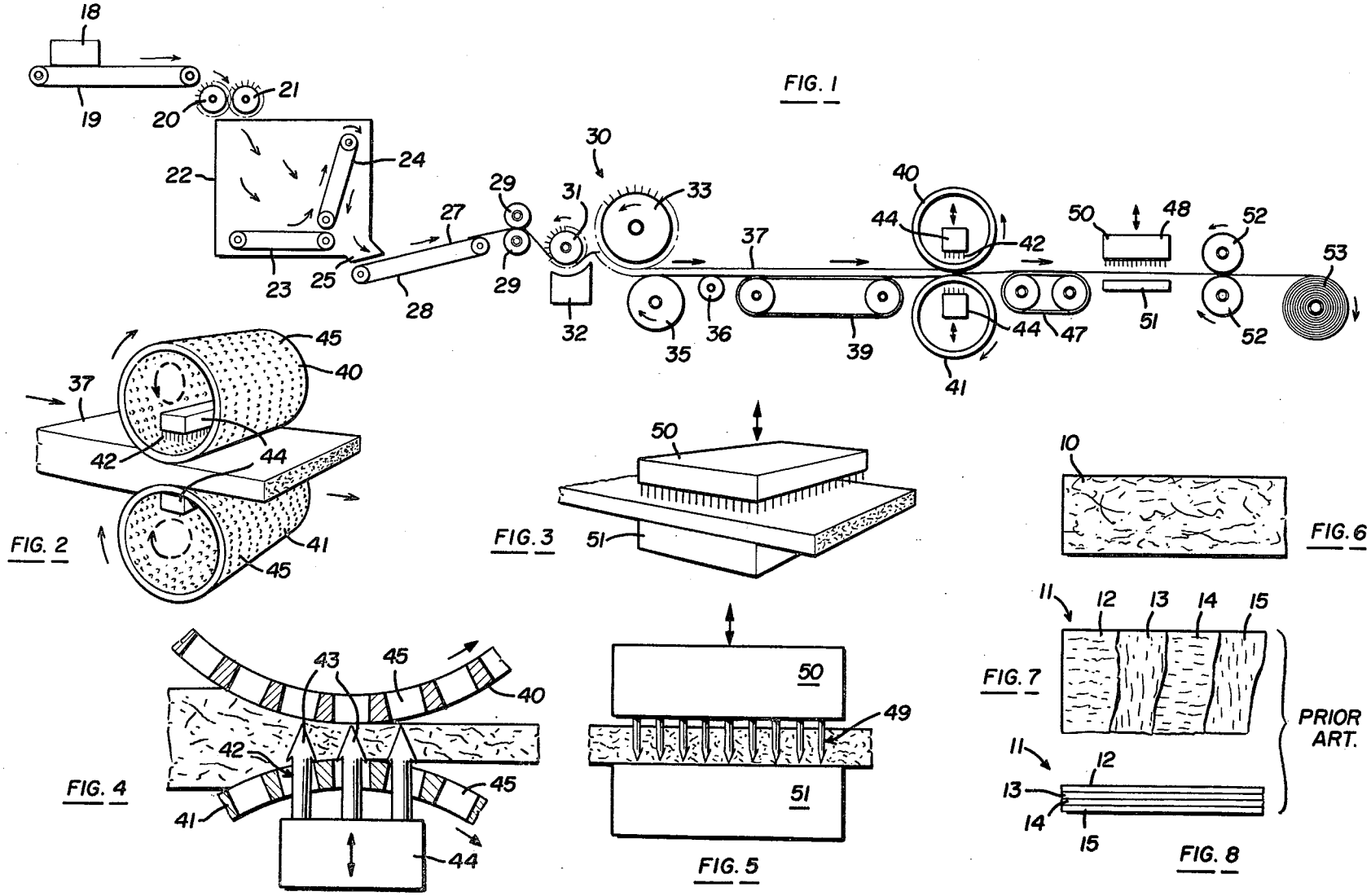
FIG. 8 PRIOR ART.
FIG. 1 is a schematic, elevational view of a line of equipment for performing the improved method herein.
FIG. 2 is a schematic, perspective fragmentary view of the compression-tacking apparatus.
FIG. 3 is a perspective, fragmentary view of the needling step.
FIG. 4 is an enlarged, fragmentary cross-sectional view of the compression-tacking step.
FIG. 5 is an enlarged, fragmentary view of the needling step.
FIG. 6 is a cross-sectional view of the non-woven padding.
FIG. 7 is a top plan view, schematically illustrating the separate oriented layers which were used in the prior art blankets.
FIG. 8 is an elevational view of the laminated or layered prior art blanket.

FIG. 6 illustrates a section of the non-woven, needled, randomly oriented fiber padding 10 which is the desired product of the method of this invention. This padding may be formed of random lengths of mixtures of fibers from different cloths or rags which are randomly oriented and intertwined to form a relatively thick pad. The thickness of the pad and the weight per unit portion thereof, may be varied substantially. For example, a typical pad may be one-eighth of an inch in thickness up to an inch or more in thickness. Its weight per unit will vary depending upon the fibers utilized. These fibers may be obtained by tearing apart rags made of any of the available types of cloth or alternatively may be made of virgin fiber materials or cloths.

In the prior art padding 11 (see FIGS. 7 and 8), a number of separate layers, as for example layers 12, 13, 14 and 15, were laid one upon another by garnet machines. Each layer is formed of fibers oriented in generally the same direction, with one layer being oriented transversely relative to the next layer. These layers were laid, one upon another, with whatever desired number of layers were specified, upon a conveyor which carry the laminar blanket through a needling machine. As can be seen, the padding produced by the method of this invention is of a single layer, eliminating the prior art garnet uses.

The process herein typically begins with a bale 18 of rags or other cloth. The bale is placed upon a bale conveyor 19 and then torn apart or shredded into constituent fibers in a conventional shredder which is schematically illustrated by the toothed rollers 20–21.

The fibers from the shredder are poured into the top of a collection chamber 22 where they fall upon a floor conveyor belt 23 that carries the fibers to a wall belt 24 which is in a generally upright arrangement. As shown by the arrows in FIG. 1, the fibers are carried up the wall belt 24 which is formed of an endless belt engaging around opposing rollers with a suitable power means. The belt itself may have surface roughenings or attachments for carrying the fibers. The fibers reaching the top of the belt fall into the space between the belt and the adjacent wall of the collection chamber and float down to an outlet 25 at the bottom of the chamber.

The fibers coming out of the outlet, which may be spread by suitable spreading rollers (not shown) form a single, thick, layer 27 upon a conveyor belt 28. The layer which is formed of loosely piled fibers that are randomly oriented, is carried by the conveyor 28 and then through guide rolls 29 to a layer reconstituting apparatus 30. This apparatus functions to tear up and reconstitute the layer in order to get better, more even distribution of the fibers within the blanket.

The layer reconstituting apparatus may include a slowly rotating roller 31 having rough, tooth-like surfaces for tearing and shredding the blanket. The blanket is guided and held against the roller 31 by means of a suitable guide plate 32.

Next to the slow roller, is a large, faster rotating roller 33 which also has a rough, toothed surface. This surface may be formed of rough mesh or of separate machined teeth or the like. The fast rotating roller pulls and shreds the blanket further.

The fiber from the now shredded blanket is drawn to a roller 35 which is provided with an internal vacuum by means of a suitable vacuum pump (not shown). This roller may have perforations on its surface in order to attract, by vacuum, the fibers which are guided along suitable rollers 36 to form a new, single layer blanket 37, like the original blanket 27, but now more evenly and carefully distributed.

The new single layer 27 is carried by a belt conveyor 39 to the compression-tacking apparatus. The compression-tacking apparatus is formed of opposed rollers 40 and 41, each containing a tack needle group 42. The points 43 of the needles may be formed in a barbed configuration, as illustrated in FIG. 4.

The needles are mounted upon a bar 44 which is carried by a mechanical mechanism that causes the needles to move outwardly of their respective rollers through perforations 45 in the roller walls. The needle bars 44 are each moved in an elliptical path as illustrated by the dotted lines in FIG. 2. Thus, the needles extend outwardly through the perforations in their respective roller walls and because of the elliptical movement of the needle bars, travel momentarily with the moving blanket and rollers and then retract. The bars successively move toward the blanket so that first one and then the other group of needles penetrate transversely of the blanket at the location of the compression or pinching.

While any suitable mechanical mechanism can be used to perform the compression or pinching step with the simultaneous needle penetration step, one commercially available machine which may be used for this purpose is known as an Asselin Tacker Type 169-DF or alternatively, a different model No. 1500-DF. These machines are used for pinching or compressing a fiber bat in the nip between the two perforated rollers or drums while simultaneously needling the bat. However, applicants believe that the use of such a machine in the present process as a substitute for and to permit replacement of garnet layering is both novel and produces unexpected results.

The blanket is next advanced upon a conveyor 47 to the needle press 48. The needle press is a conventional apparatus utilizing a densely arranged group of needles 49 mounted upon a vertically reciprocating platen 50. Upon downward movement, the needles transversely penetrate the blanket and depending upon the predetermined spacing, the platen may compress the blanket against a lower platen 51. The needling is rapid and repetitive so as to hit each section of the blanket numerous times for intertwining the fibers and causing them to interlock. These needles may likewise have barbed tips, if desired.

The blanket after the needling, is pulled by pull rollers 52 to a suitable conventional mechanism to wind the blanket into a roll 53. In commercial practice, the roll may be sent to another place where it can be utilized to manufacture products or alternatively, instead of a roll, the blanket may be die cut into predetermined sizes or shapes to make finished products directly off the line.

The number of needles per unit area and the number of times the needles penetrate the blanket incremental areas may be varied, depending upon the requirements or specifications, of the finished product. The resultant product typically contains a mixture of different fibers obtained from different rags or cloths, with the fibers randomly oriented and mechanically intertwined and interlocked to form a stable pad or mat which is difficult to tear or dimensionally disturb. Thus, this pad may be used for a variety of purposes as explained previously.

Having fully described an operative embodiment of this invention, we now claim:

1. A method for making a relatively dense, thick pad of non-woven fabric fibers comprising essentially the steps of:

(a) shredding a mass of cloth-like material into fabric fibers;

(b) collecting and forming the fabric fibers into a continuous, single layer of loosely piled and randomly oriented fibers, with the layer being considerably thicker than the desired pad thickness;

(c) moving the fiber layer against a slowly rotating roller having tooth-like surfaces and then against a faster rotating roller having a rough toothed surface for tearing and shredding the fiber layer further thereby reconstituting the fiber layer to obtain a more even distribution of the fibers;

(d) momentarily compressing sequential increments along the length of the fiber layer;

(e) simultaneously during the compression of each increment, extending first and second groups of spaced apart needles transversely through the compressed layer increment for intertwining and thereby, interlocking a limited portion of the fibers within the compressed increment, wherein said compression step comprises passing the layer between a pair of opposed rollers for said compression, with each roller being formed of a cylindrical wall having numerous openings, with said first group of needles being located within one of said rollers and said second group of needles being located within the other of said rollers, and the needles of said first and second groups each being momentarily extended in an elliptical path through the roller openings for transversely extending through the layer during the time the rollers compress the layer increment then located between the rollers, and successively moving said needles toward the fiber layer so that said first group and then said second group of needles penetrate the fiber layer at the location of the compression;

(f) thereafter, finally needling the layer incrementally along its length by repeatedly extending a third group of a large number of closely spaced needles transversely through the layer for securing the fibers together to form the non-woven pad, said first and second groups of needles are of considerably lesser density than the third group of needles so that the needles of the first and second groups penetrate through the layer at relatively more widely spaced apart locations as compared with the needles of the third group, and including compressing the portion of the layer being needled while finally needling it.

* * * * *